United States Patent [19]

Otaki

[11] Patent Number: 4,501,411

[45] Date of Patent: Feb. 26, 1985

[54] GUARDRAIL FOR ROADWAY

[76] Inventor: Yoshio Otaki, 35, Hayakitachooomachi, Yufutsu-gun, Hokkaido, Japan

[21] Appl. No.: 528,586

[22] Filed: Sep. 1, 1983

[51] Int. Cl.[3] ..... A01K 3/00

[52] U.S. Cl. ..... 256/13.1; 256/19; 248/66

[58] Field of Search ..... 256/13.1, 19; 248/66

[56] References Cited

U.S. PATENT DOCUMENTS

| | | | |
|---|---|---|---|
| 1,711,898 | 5/1929 | Meaker | 256/13.1 |
| 2,265,698 | 12/1941 | Opgenorth | 256/13.1 |
| 2,915,879 | 12/1959 | Besse | 256/13.1 X |
| 3,377,053 | 4/1968 | Burdett | 256/13.1 |

FOREIGN PATENT DOCUMENTS

| | | | |
|---|---|---|---|
| 2457929 | 1/1981 | France | 256/13.1 |
| 707066 | 3/1966 | Italy | 256/13.1 |

*Primary Examiner*—Andrew V. Kundrat

*Attorney, Agent, or Firm*—Armstrong, Nikaido, Marmelstein & Kubovcik

[57] ABSTRACT

A guardrail for roadway has a row of a plurality of steel posts secured in a row to the ground outside and along one side edge of a roadway, such as a shoulder of the roadway or a median strip between roadways. In the case where the posts are disposed along the shoulder of a roadway, each post has an inverted "L" shape providing an arm extending from the top of the post towards an adjacent lane of the roadway. A network of cables is provided to extend between the outer ends of the arms of respective posts and the ground in the shoulder of the roadway. The network is formed by supporting cables each extending between the outer end of one arm and an anchor secured to the ground in the shoulder and lateral or horizontal cables secured to the supporting cables. Each supporting cable is inclined at an angle downwardly and forwardly of the movement of vehicles on the roadway. In the case where the posts are disposed on the median strip, each strip has either "T" or "Y" shape.

9 Claims, 4 Drawing Figures

GUARDRAIL FOR ROADWAY

BACKGROUND OF THE INVENTION

The present invention relates to a guardrail laid along the shoulder or edge of a roadway to prevent vehicles from accidentally running off the roadway or laid along the median strip to prevent vehicles from accidentally crossing into the opposite lane.

Conventional guardrails have iron or steel posts driven into the ground along the sholder or median strip at a constant pitch and steel strips or wire ropes attached to the posts so as to connect these posts. When a running vehicle has come into collision with the guardrail, the vehicle may be heavily damaged and the driver and occupants seriously injured by the posts which are very rigidly set. In some cases, an edge bank of a height of 20 to 30 cm above the roadway surface is laid along the border between the guardrail and the lane. It is often experienced that a vehicle coming into contact with the guardrail at an acute angle runs on to such an edge bank and jumps up and is overturned resulting in a serious accident.

SUMMARY OF THE INVENTION

It is an object of the present invention to provide an improved guardrail for a roadway which is operative to absorb the shock of collision of a vehicle against the guardrail to stop the vehicle with a relatively small magnitude of shock and prevent the vehicle from being overturned.

The guardrail according to the present invention includes a row of a plurality of posts disposed outside and extending along one side edge of a roadway, said posts being arranged at a predetermined pitch, each of said posts having a lower end section rigidly secured to the ground, an intermediate section extending upwardly from said lower end section and at least one arm extending from the upper end of said intermediate section towards an adjacent lane of the roadway and terminating in an outer end positioned substantially above said side edge of said roadway, the vertical distance between said outer end of said arm and said side edge of said roadway being greater than the heights of vehicles moving on said roadway; anchors rigidly secured to the ground in said side edge of said roadway substantially at said predetermined pitch; and a network formed by supporting cables each extending between the outer end of the arm of one of said posts and one of said anchors and lateral cables extending substantially parallel to the surface of said roadway and rigidly secured to said supporting cables, each of said supporting cables being inclined downwardly and forwardly of the movement of vehicles on said roadway.

The above and other objects, features and advantages of the invention will be made apparent by the following description of preferred embodiments with reference to the accompanying drawings.

DESCRIPTION OF THE PREFERRED EMBODIMENTS

Figure 1:
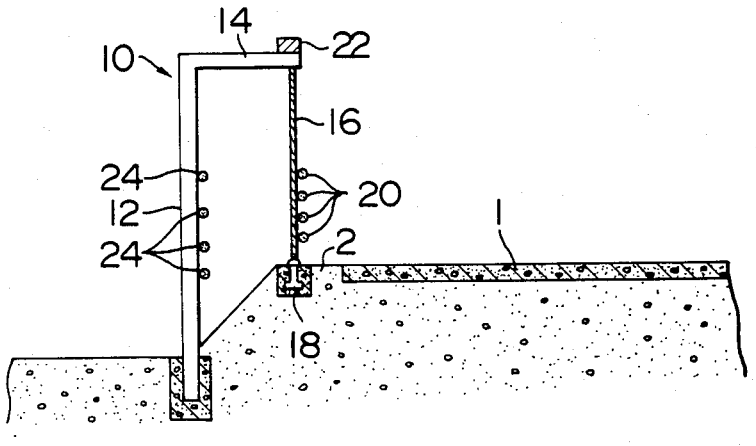
FIG. 1 is a partly-sectioned side elevational view of an embodiment guardrail of the invention laid on a shoulder or edge of a roadway.
Figure 2:
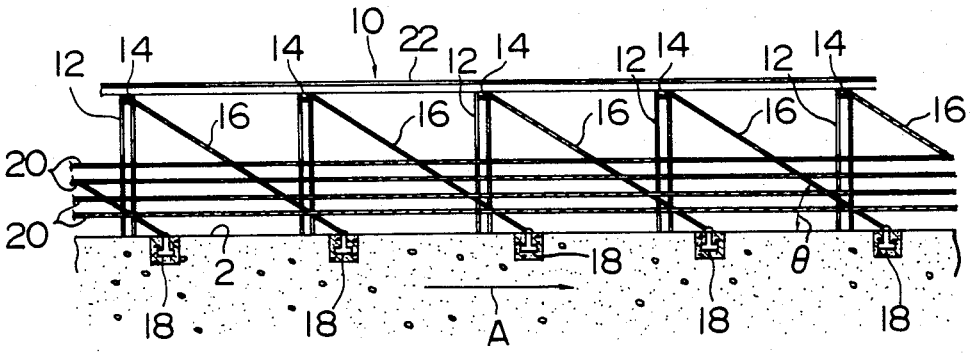
FIG. 2 is a front elevational view of the guardrail shown in FIG. 1.

Referring first to FIGS. 1 and 2, a guardrail 10 embodying the present invention has a plurality of steel posts 12 driven into the ground and disposed at a predetermined constant pitch, e.g. 3 to 5 meters, along a line parallel to and outside the outer edge of the shoulder 2 of a roadway 1. Each of the posts 12 is bent at its upper end towards the roadway 1 so that the extremity of the bent end is positioned above the outer edge of the shoulder 2. The bent end of each post 12 constitutes a substantially horizontal arm 14 for retaining the upper end of a supporting guard line 16 which will be detailed later. The height of the post 12 is selected such that the vertical distance between the outer end of the arm 14 and the surface of the shoulder 12 of the roadway 1 is greater than the height of vehicles. Therefore, if the guardrail is intended for protecting mainly vehicles of small sizes such as ordinary passenger cars, the vertical distance between the arm 14 and the shoulder 12 is 2 meters or so. However, when large-sized vehicles are taken into account, the vertical distance is preferably selected to be about 3 meters.

A plurality of anchors 18 for securing the lower ends of the supporting guard lines 16 are fixed to the ground along the outer edge of the shoulder 2 at a pitch substantially equal to that of the posts 12. Each supporting guard line 16 is constituted by a wire rope or cable connected to the end of an arm 14 and the corresponding anchor 18 so that the cable extends under tension, obliquely and downwardly in the direction of movement of vehicles represented by an arrow A in FIG. 2.

The angle $\theta$ formed between each supporting guard line 16 and the surface of the shoulder 2 is selected to fall preferably within a range of from 25° to 35°.

A plurality of wire ropes or cables 20 extend in parallel with the roadway surface and are connected to the supporting guard lines 16. These cables 20 constitute lateral guard lines. The connections of the lateral guard lines 20 to the supporting guard lines 16 are formed by securing or uniting together the cables constituting these supporting and horizontal lines at each of the crossing points of these cables by conventional rope securing means such as clamps (not shown). Preferably, the lateral cables 20 are disposed on the sides of the supporting cables 16 adjacent to the lane of the roadway.

As will be understood from the foregoing description, the guardrail 10 provided along the shoulder 2 of the roadway 1 has a plurality of posts 12 having arms 14, anchors 18 fixed to the shoulder 2, supporting guard lines 16 constituted by cables connected to the arms 14 and corresponding anchors 18 so as to extend obliquely downwardly in the direction of running of vehicles, and a plurality of horizontal lines 20 attached to the supporting guard lines 16 and extending in parallel with the roadway surface.

This embodiment of the guardrail of the invention advantageously absorbs and reduces any shock in the event of a collision by a vehicle and remarkably abates the seriousness of the accident due to the elasticity of the cables and smoothness of the cable surfaces. More specifically, when a vehicle collides with the guardrail, it first comes into contact with the cables of the horizontal lines 20 at an acute angle, so that the horizontal lines 20 are elastically stretched or deformed outwardly to absorb the energy of the collision impact. In addition, the smooth surfaces of the ropes of the horizontal lines 20 facing the roadway allow the vehicle to slide forwardly a distance on the horizontal lines 20 in frictional contact therewith. During this sliding movement, the friction absorbs the force of inertia to apply a braking effect to the vehicle. It will be understood that the energy absorption effect and the frictional braking effect explained above provided by the guardrail of the invention assure a greater effect to reduce the shock on the occupants and vehicles as compared with conventional guardrail of rigid construction. In addition, the cables of the supporting guard lines 16 which extend obliquely downwardly in the direction of running of vehicles provide an additional advantage that, when the colliding vehicle slides on the horizontal lines 20, the inclined supporting lines 16 produce a force which acts on the vehicle to urge the vehicle downwardly. In consequence, the lifting or "floating-up" of the vehicle colliding with the guardrail is suppressed to avoid the danger of jumping up and turning sideways of the vehicle which would otherwise occur with the conventional guardrail when the vehicle has run onto the edge bank extending along the guardrail.

Preferably, the ends of the arms 14 are connected by strips 22 such as an angle or channeled steel. It is also preferred to connect the posts 12 by a plurality of cables 24. The cables 24 serve as a secondary or auxiliary protective guard when the vehicle has broken the primary protective guard provided by the network formed by the inclined supporting guard lines 16 and the horizontal guard lines 20.

Figure 3:
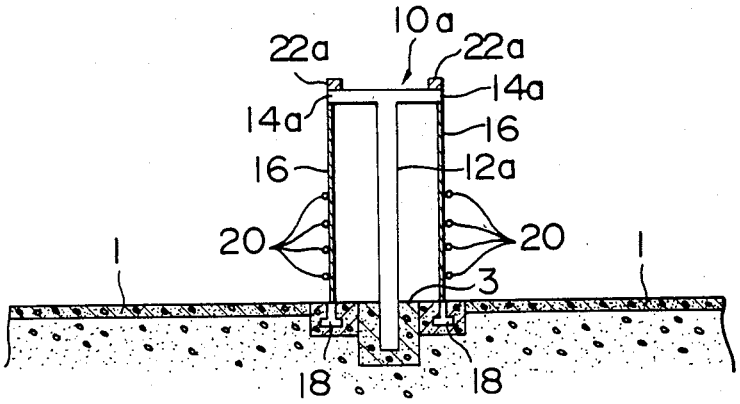
FIG. 3 is a partly-sectioned side elevational view of another embodiment of the guardrail of the invention laid along median strip of a roadway.

FIG. 3 shows another embodiment 10*a* of the guardrail of the invention which is suitable for use on the median strip 3 of a roadway. The guardrail 10*a* is different from the first embodiment 10 only in the following points: The guardrail 10*a* has a multiplicity of steel posts 12*a* disposed in a row along the center line of a median strip 3 of a roadway 1. Each post 12*a* has a T-shaped upper end, the arms 14*a* of which extend toward both lanes and have outer ends to which inclined supporting guard lines 16 are secured at their upper ends. The guardrail 10*a* further has anchors 18 which are fixed to the ground in two rows along the edges of the lanes adjacent to the median strip 3. The supporting guard lines 16 are formed by cables extending between the arms 14 and cooperating anchors 18. As in the case of the first embodiment described in connection with FIG. 2, these cables extend under tension obliquely downwardly in the direction of running of vehicles, although this feature is not shown in FIG. 3. The guardrail 10*a* further has horizontal lines constituted by a plurality of cables 20 extending in parallel with the roadway surface and secured to the supporting guard lines 16. The ends of both arms 14*a* of each adjacent pair of posts 12*a* are connected by strips 22*a* such as an angled or channeled steel. These features are also similar to those of the first embodiment described in connection with FIGS. 1 and 2. It will be clear to those skilled in the art that the second embodiment 10*a* of the guardrail of the invention provides advantages similar or identical to those of the first embodiment.

Figure 4:
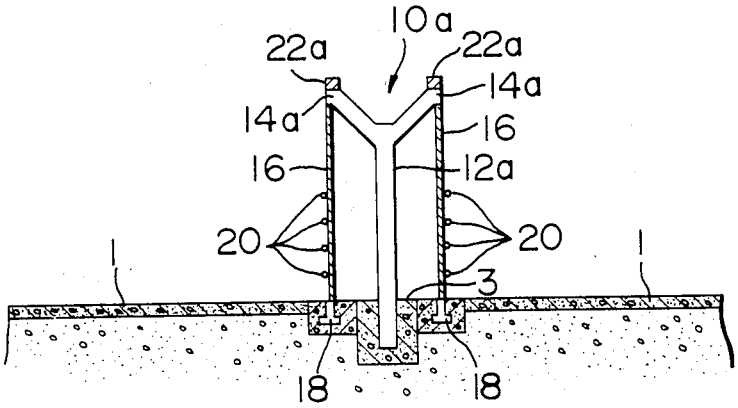
FIG. 4 is a view similar to FIG. 3 but illustrates a modification to the embodiment shown in FIG. 3.

Although the invention has been described through specific terms, it is to be noted that the described embodiments are not exclusive and various changes and modifications may be made without departing from the scope of the invention. For example, the "T" shape of the posts 12*a* may be modified into "Y" shape, as shown in FIG. 4.

What is claimed is:

1. A guardrail for a roadway, including a row of a plurality of posts disclosed outside and extending along one side edge of a roadway, said posts being arranged at a predetermined pitch, each of said posts having a lower end section rigidly secured to the ground, an intermediate section extending upwardly from said lower end section rigidly secured to the ground, an intermediate section extending upwardly from said lower end section and at least one arm extending from the upper end of said intermediate section towards an adjacent lane of the roadway and termintating in an outer end positioned substantially above said side edge of said roadway, the vertical distance between said outer end of said arm and said side edge of said roadway being greater than the heights of vehicles moving on said roadway; anchors rigidly secured to the ground in said side edge of said roadway substantially at said predetermined pitch; and a network formed by supporting cables each extending between the outer end of the arm of one of said posts and one of said anchors and lateral cables extending substantially parallel to the surface of said roadway and rigidly secured to said supporting cables, each of said supporting cables being inclined downwardly and forwardly from the outer end of the arm of one of sand posts in the direction of traffic on said roadway.

2. A guardrail according to claim 1, wherein said roadway has a shoulder which forms said side edge and wherein said posts are secured to the ground outside and along said shoulder, each of said posts having a substantially inverted "L" shape.

3. A guardrail according to claim 1, wherein each of said posts are disposed on a median strip between two roadways and has a pair of arms extending from the upper end of said intermediate section in substantially the opposite ditections.

4. A guardrail according to claim 1, wherein the angle of inclination of each of said supporting cables to the roadway surface ranges from 25° to 35°.

5. A guardrail according to claim 1, further including auxiliary lateral cables extending substantially parallel to the roadway surface and rigidly secured to the intermediate sections of said posts.

6. A guardrail according to claim 1, further including means for mechanically connecting the outer ends of said arms of said posts.

7. A guardrail according to claim 3, wherein each of said posts is substantially "T"-shaped.

8. A guardrail according to claim 3, wherein each of said posts is substantially "Y"-shaped.

9. A guardrail according to claim 1, wherein said lateral cables are disposed on the sides of said supporting cables adjacent to the lane of said roadway.

* * * * *